US007207928B2

(12) United States Patent
Arrington

(10) Patent No.: US 7,207,928 B2
(45) Date of Patent: Apr. 24, 2007

(54) MULTI-STATION MARTIAL ARTS PRACTICE DEVICE

(76) Inventor: Wayne Arrington, 4603 Valleybrook Cir., College Station, TX (US) 77845

( * ) Notice: Subject to any disclaimer, the term of this patent is extended or adjusted under 35 U.S.C. 154(b) by 431 days.

(21) Appl. No.: 10/858,514

(22) Filed: Jun. 1, 2004

(65) Prior Publication Data

US 2005/0266966 A1 Dec. 1, 2005

(51) Int. Cl.
*A63B 69/00* (2006.01)
*A63B 69/22* (2006.01)

(52) U.S. Cl. ..... 482/83; 482/90

(58) Field of Classification Search ..... 482/83, 482/86–90, 84, 85; D21/798
See application file for complete search history.

(56) References Cited

U.S. PATENT DOCUMENTS 547,730 A 10/1895 MacLearn
581,462 A 4/1897 Hess
2,085,161 A 6/1937 Kraus
2,576,660 A 11/1951 Williams
2,976,033 A 3/1961 Martin
3,427,021 A 2/1969 Donato
4,403,772 A 9/1983 Stangle
4,486,016 A 12/1984 Rubin
4,491,316 A 1/1985 Prince
4,572,504 A 2/1986 DiBartolo
4,662,630 A 5/1987 Dignard et al.
4,705,447 A 11/1987 Smith
4,757,989 A 7/1988 Bauer, Jr.
4,787,625 A 11/1988 Chaloux
4,889,334 A 12/1989 Partlo
4,973,045 A 11/1990 Heberer
5,277,679 A 1/1994 Wells
5,330,403 A 7/1994 Kuo
5,342,267 A * 8/1994 Adams et al. ..... 482/83
5,362,289 A 11/1994 Holt
5,415,371 A 5/1995 Kirchner
5,458,551 A 10/1995 Shenton
5,476,433 A 12/1995 Bruner
5,624,358 A 4/1997 Hestilow
5,665,035 A 9/1997 Tumminia
5,863,279 A 1/1999 Pouliot
6,027,435 A * 2/2000 Nadorf et al. ..... 482/146
6,149,553 A 11/2000 Antoszewski
6,217,490 B1 4/2001 Wurtak
6,302,831 B1 * 10/2001 Henry ..... 482/83
6,432,027 B1 * 8/2002 Haselrig ..... 482/83
6,872,171 B2 * 3/2005 Haselrig ..... 482/83
6,896,642 B1 * 5/2005 Brown ..... 482/83
7,086,997 B1 * 8/2006 Fields et al. ..... 482/90

* cited by examiner

*Primary Examiner*—(Jackie) Tan-Uyen Ho
*Assistant Examiner*—Victor K. Hwang
(74) *Attorney, Agent, or Firm*—Marcus W. Hammack

(57) ABSTRACT

A multi-station martial arts practice device with multiple practice board supports with differing board orientations and a base non-permanent installation in a practice facility.

1 Claim, 3 Drawing Sheets

MULTI-STATION MARTIAL ARTS PRACTICE DEVICE

BACKGROUND OF THE INVENTION

1. Field of the Invention

The present invention relates to athletic training devices.

2. Background Information

Martial arts training and skills retention require frequent and time-consuming practice. Many martial arts disciplines require the successful demonstration of the breaking of boards, or the like, by hands, feet, or both. The ability to demonstrate this technique comes only with extensive, repetitive practice.

Regrettably, "board practice" tends to require involvement of at least one other person (one who holds the board), and, as a practical matter, two other persons. This is a problem because such people are not always available. Even if others are available, holding boards while another repeatedly breaks them is the concept of fun for but a few.

Some effort has gone into providing for solo board practice. For example, the following U.S. patents reveal devices which are designed to hold boards during martial arts practice: U.S. Pat. Nos. 4,662,630; 4,757,989; 4,889,334; 4,973,045; 5,415,371; 5,476,433; 5,665,035; 5,277,679; 5,863,279; 6,149,553. Each of these approaches are deficient in at least one of two primary respects: (1) they are designed to hold only one board, on one position; and/or (2) they are not designed to adequately absorb inadvertent impact to the device itself.

The significance of the first noted deficiency is fairly evident. Board-breaking exercises in martial arts involve, as previously mentioned, actions by both foot and hand. In addition, the position of the to-be-broken board may be different for either. A device which holds merely one board, even if it is adjustable for differing positions or orientations, slows progress considerably. This, in turn, actually proves to be a disincentive to practice, particularly for youth.

As for the second noted deficiency, one should note that practice, particularly in training, will involve less than perfect execution, perhaps much of the time. Quite simply, the practicing individual may simply miss the board entirely, and strike the holding device itself (particularly for kicking exercises, where fine control is a later developed attribute. Clearly, injury to the trainee by inadvertent contact with the board holding device is to be avoided.

Despite the referenced measures to provide opportunities for solo martial arts practice, there still exist deficiencies and resulting needs in this area.

SUMMARY OF THE INVENTION

In view of the foregoing, it is an object of the present invention to provide an improved martial arts training device.

It is another object of the present invention to provide an improved martial arts training device, particularly useful for solo practice of board breaking exercises.

It is another object of the present invention to provide an improved martial arts training device, particularly useful for solo practice of board breaking exercises, which afford simultaneous practice opportunities involving boards held at differing positions or orientations.

It is another object of the present invention to provide an improved martial arts training device, particularly useful for solo practice of board breaking exercise, which device is designed to absorb some degree of impact to the holding device itself, such as in the event of inadvertent striking of the device during practice.

In satisfaction of these and other related objectives, Applicant's present invention provides an improved martial arts training device, particularly for use in board breaking exercises. The device, depending on the particular embodiment, includes board mounting means for holding a plurality of boards in like or differing positions or orientations. In addition, the device includes a shock-absorbing support structure which allows some degree of shock absorption when/if the device itself is impacted during practice or training. Further still, the device, by its design, lends itself to portability, requiring no permanent installation or structural requirements or modifications to a facility in which the device is to be used.

DETAILED DESCRIPTION OF THE PREFERRED EMBODIMENT

Figure 1:
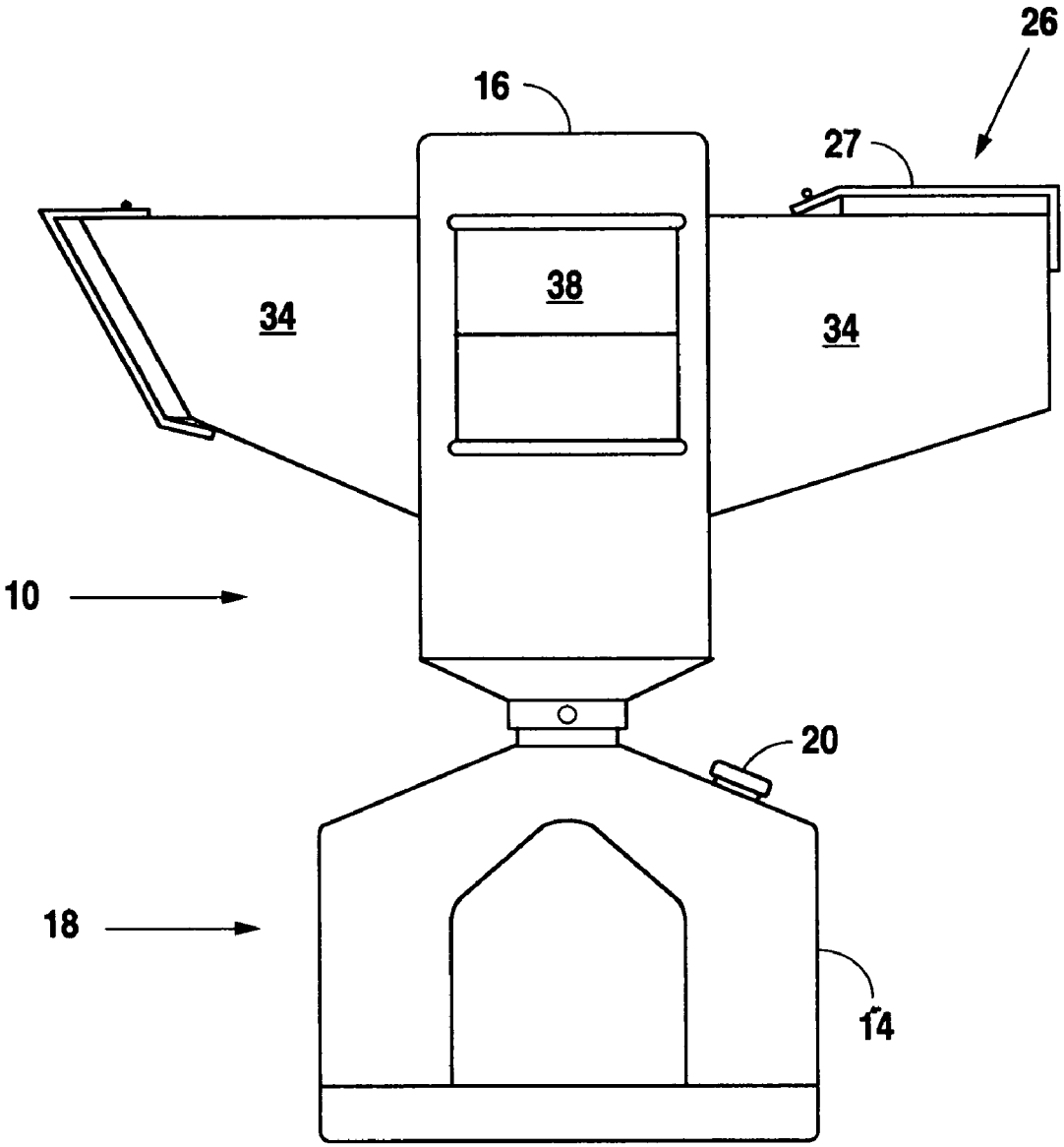
FIG. 1 is a side elevational view of the preferred embodiment of a multi-station martial arts training device of the present invention
Figure 2:
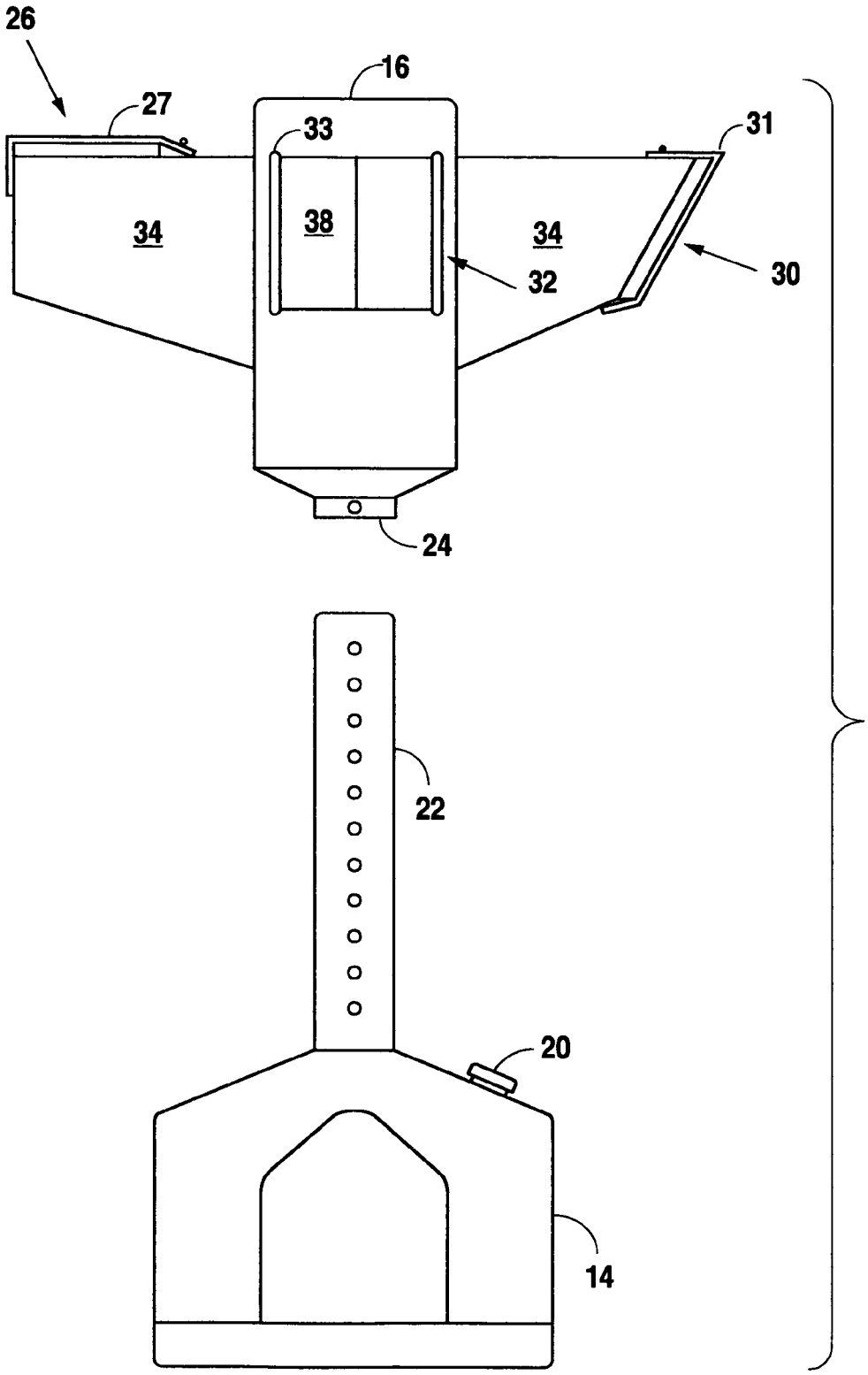
FIG. 2 is an exploded view of the device of FIG. 1, wherein the base/pedestal unit is separated from the board support assembly.
Figure 3:
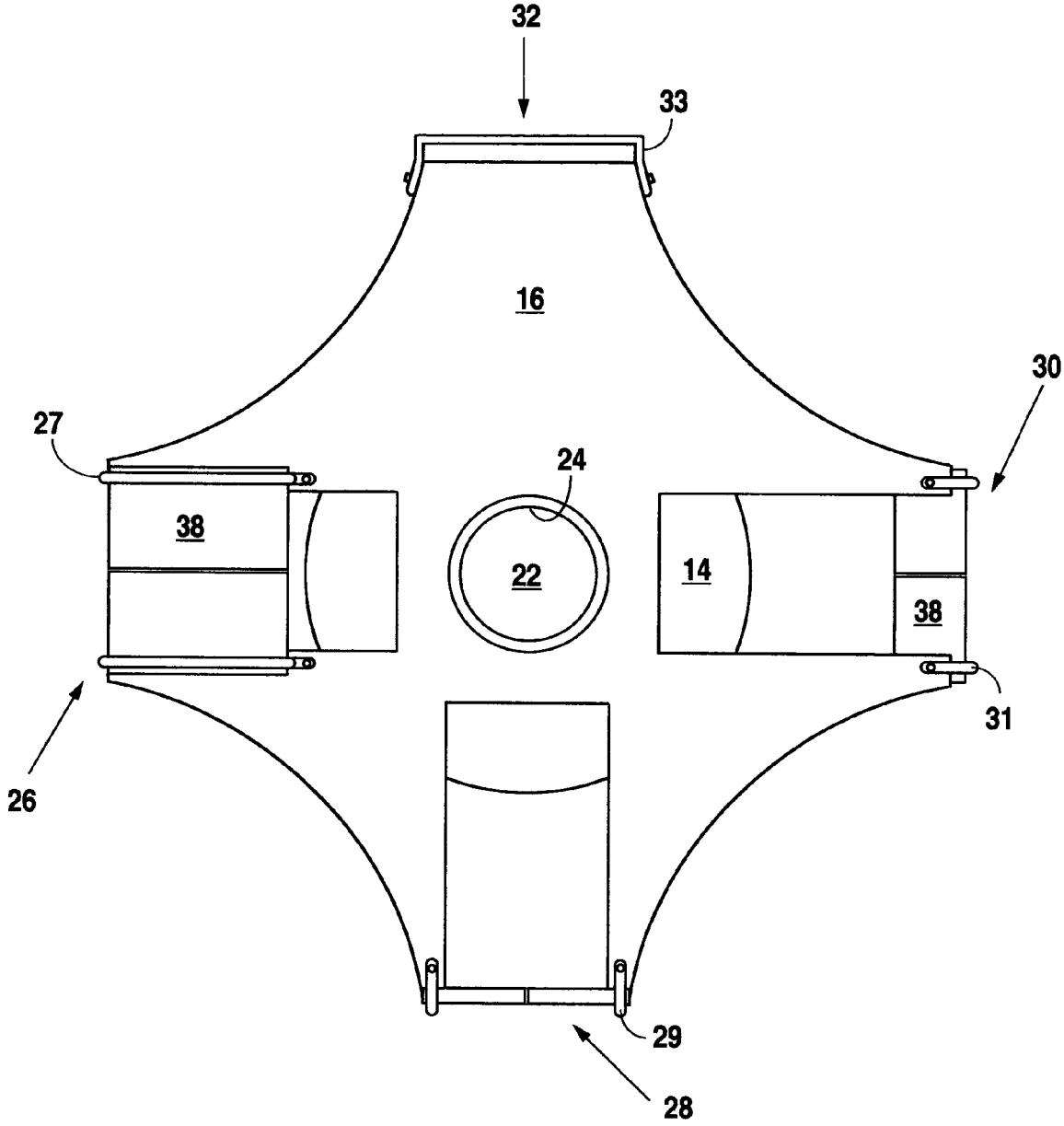
FIG. 3 is a top plan view of the embodiment of FIGS. 1 and 2.

With reference to FIGS. 1–3, the multi-station martial arts training device of the present invention is identified generally by the reference number 10.

Device 10 includes a base/pedestal unit 14 and a board support assembly 16.

Base/pedestal unit 14 includes a base member 18 which, in the preferred embodiment, is a hollow structure with filling orifice 20 through which water or sand may be introduced into base member 18 to provide weight and stability. Conversely, such filling material may be removed from base member 18 when device 10 is to be moved from one location to another.

Base member 18 includes a flat resting surface for resting on a floor surface during use of device 10.

Base/pedestal unit 14 includes a support column 22 which extends along the extended axial center line of base member 18, opposite its flat resting surface. Support column 22 is sized and shaped for telescopic reception into recess 24 of board support assembly 16.

In one embodiment of the present invention, the transition from base member 18 and support column 22, is of bellows-like construction, so that support column 22 can "give" in response to impact of support column 22 (or, in actuality, to board support assembly 16 which, in use of the present invention will engage support column 22). It should be noted, however, that even a non-corrugated juncture will not render the present invention substantially less "forgiving" of impact, a there is no rigid engagement between device 10 and any floor or wall surface. Of further note is the fact that alternative shock-absorption designs may be incorporated into the present invention, including alternatives to the corrugated transition structure, and may include (as additions or alternatives), for example, a slightly rounded floor surface for base/pedestal unit 14.

Further still, support column 22 may be made detachable from base member 18, such as by threaded or bayonet mount configurations (not shown in the drawings), particularly in view of shipping considerations.

Board support assembly 16 is, in the preferred embodiment, formed of molded plastic. This addresses concerns of manufacturing expense, as well as safety and weight (for facilitating portability). It should be understood, however, that alternative embodiment in which any of the cited components are made of metal, for example, would certainly fall within the scope of the present invention.

Board support assembly 16 includes, in the preferred embodiment, four stations 26, 28, 30, and 32. Each station is formed substantially by arms or projections 34 which extend outwardly from the central core of board support assembly 16. Of course, units with fewer or greater numbers of stations may be manufactured, however, it is believed that the present four station model is optimal.

Station 26 includes board support means 27 for holding a board 38 in position for executing an ax kick (horizontally oriented with the intended break line being oriented as if the shaft of an arrow pointing at the user).

Station 28 includes board support means 29 for holding a board 38 in position for front kicks or palm heel strikes (vertically oriented with the intended break line being substantially perpendicular with the plane of a floor surface on which device 10 rests and the plane of a face of the board is spaced from the axial centerline of the support column).

Station 30 includes board support means 31 for holding a board 38 in position for a front kick or upward elbow strike (slanted downward relative to a floor surface).

Station 32 includes board support means 33 for holding a board 38 in position for side or round kicks (vertically oriented with the intended break line being substantially parallel to the plane of a floor surface on which device 10 rests).

In each instance, board support means 27, 29, 31 and 33 are, in one embodiment of the present invention, in the form of rails with end stops on the same respective end of each pair of rails, the rails being configured for sliding engagement with boards 38. In such an embodiment, board support means 27 are attached to projections 34 through interaction of integrally molded features, through mechanical engagement of nuts, bolts, etc., or in any other conventional manner a fabricator sees fit. Alternative embodiments of the present invention may involve, instead of separate, attached rails, detachable elastic straps which hold boards in-place or yieldable tabs or other integrally molded recesses or engagement features with which practice boards 38 are engaged.

Each board support means may support a practice board 38 in a respectively unique orientation or position, or any two or more stations may duplicate the board orientation or position of another station, depending on the manufacturer's preferences. The preferred embodiment, however, does involve stations, each with respectively unique positions as previously described. Of further note is the fact that any one station may also include two boards, one on its outer face (as depicted for stations 28, 30 and 32), and another on a top surface (such as depicted for station 26). This will enable the elimination of one station from the product design, without sacrificing the number of board orientations provided by any one embodiment of the present invention.

Use of device 10 is straightforward. Practice boards 38 are placed at such stations as are appropriate for the moves which a user chooses to practice. Boards 38 are slid into position as shown, and the maneuver is practiced. Upon breaking one or all boards 38, they are reassembled and replaced for further practice or training.

Because of the inherent shock-absorbing characteristics of device 10, accidental impact by a user of any portion of device 10 adjacent to boards 30 is much less likely to render injury than such a misstep with presently available units as discussed above.

Although the invention has been described with reference to specific embodiments, this description is not meant to be construed in a limited sense. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

I claim:

1. A martial arts training device comprising:

a base unit, said base unit having a substantially planar floor resting surface, said base unit having an interior void for reversibly encasing ballast material;

an elongate support column, said support column having a proximal end and a distal end, said support column being attached to said base unit at said proximal end of said support column and extending vertically along an axial centerline in a direction substantially opposite said substantially planar floor resting surface of said base unit, said elongate support column being cylindrical;

a board support assembly, said board support assembly being substantially cylindrical in shape, said board support assembly having a lower end and an upper end, said board support assembly having a recess sized and shaped for telescopic reception of said support column;

a first training station, said first training station being attached to and extending radially from said board support assembly, said first training station adapted to support a martial arts training board in a position perpendicular to said floor resting surface such that the plane of a face of the board is spaced from the axial centerline;

a second training station, said second training station being attached to and extending radially from said board support assembly, said second training station being positioned substantially perpendicular to said first training station, said second training station adapted to support a martial arts training board in a position parallel with said floor resting surface;

a third training station, said third training station being attached to and extending radially from said board support assembly, said third training station being positioned substantially perpendicular to said second training station, said third training station adapted to support a martial arts training board in a slanted position with respect to said floor resting surface; and a fourth training station, said fourth training station being attached to and extending radially from said board support assembly, said fourth training station being positioned substantially perpendicular to said third training station, said fourth training station adapted to support a martial arts training board in a position perpendicular to said floor resting surface.

* * * * *